US008926053B2

(12) United States Patent
Hatanaka

(10) Patent No.: US 8,926,053 B2
(45) Date of Patent: Jan. 6, 2015

(54) RECORDING APPARATUS, METHOD FOR ADJUSTING DEVIATION OF PRINT POSITION FOR RECORDING APPARATUS, AND COMPUTER PROGRAM PRODUCT

(75) Inventor: Shinichi Hatanaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 182 days.

(21) Appl. No.: 13/511,418

(22) PCT Filed: Dec. 14, 2010

(86) PCT No.: PCT/JP2010/072832

§ 371 (c)(1),
(2), (4) Date: May 23, 2012

(87) PCT Pub. No.: WO2011/074687

PCT Pub. Date: Jun. 23, 2011

(65) Prior Publication Data

US 2012/0293579 A1 Nov. 22, 2012

(30) Foreign Application Priority Data

Dec. 14, 2009 (JP) ..... 2009-282787
Dec. 13, 2010 (JP) ..... 2010-276831

(51) Int. Cl.
*B41J 29/393* (2006.01)

(52) U.S. Cl.
CPC ..... *B41J 29/393* (2013.01)
USPC ..... 347/19; 347/23

(58) Field of Classification Search
CPC ..... B41J 25/001; B41J 2/2135; B41J 2/512
USPC ..... 347/15, 19, 23
See application file for complete search history.

(56) References Cited

U.S. PATENT DOCUMENTS 6,334,720 B1 * 1/2002 Kato et al. ..... 400/74
2007/0019214 A1 * 1/2007 Saito ..... 358/1.1
2009/0058910 A1 3/2009 Hatanaka et al.

FOREIGN PATENT DOCUMENTS

CN 101234559 8/2008
JP 9 123482 5/1997

(Continued)

OTHER PUBLICATIONS

International Search Report Issued Jan. 25, 2011 in PCT/JP10/72832 Filed Dec. 14, 2010.

(Continued)

*Primary Examiner* — Julian Huffman
*Assistant Examiner* — Sharon A Polk
(74) *Attorney, Agent, or Firm* — Oblon, Spivak, McClelland, Maier & Neustadt, L.L.P.

(57) ABSTRACT

A recording apparatus includes: a recording unit; an adjustment-chart output unit that outputs an adjustment chart for adjusting deviation of a print position between a first dot and a second dot that are formed for images on a recording medium at different timings with a print head; and an ejection-position adjusting unit that records a plurality of combinations, each containing a reference pattern for reference of an image position and adjustment patterns that are deviated from the reference pattern in a stepwise manner such that the deviation amounts are shifted by M-times of a deviation amount corresponding to the recording resolution, receives selection of an adjustment pattern closest to the reference pattern from the outside, obtains an adjustment value based on the adjustment pattern of the selected combination, sets the adjustment value as a new adjustment value, and adjusts an ejection position of the print head.

11 Claims, 12 Drawing Sheets

(56) References Cited

FOREIGN PATENT DOCUMENTS

| | | |
|---|---|---|
| JP | 11 5319 | 1/1999 |
| JP | 2000 190482 | 7/2000 |
| JP | 2001 341392 | 12/2001 |
| JP | 3384376 | 3/2003 |
| JP | 2004-291651 | 10/2004 |
| JP | 2004-314434 | 11/2004 |
| JP | 3591286 | 11/2004 |
| JP | 2006-027282 | 2/2006 |
| JP | 3777897 | 5/2006 |
| JP | 2009 61610 | 3/2009 |
| JP | 4296043 | 7/2009 |

OTHER PUBLICATIONS

Chinese Office Action dated Mar. 19, 2014 in corresponding Chinese patent application No. 201080056713.X, with English translation, 14 pages.

* cited by examiner

DEVIATION GREATER THAN RECORDING RESOLUTION IS GENERATED SO THAT DIFFERENCE CAN BE EASILY DISTINGUISHED

DEVIATION AMOUNT EQUAL TO RECORDING RESOLUTION RESULT IN SLIGHT DIFFERENCE, SO THAT IT IS DIFFICULT TO DISTINGUISH DIFFERENCE

RECORDING APPARATUS, METHOD FOR ADJUSTING DEVIATION OF PRINT POSITION FOR RECORDING APPARATUS, AND COMPUTER PROGRAM PRODUCT

TECHNICAL FIELD

The present invention relates to a recording apparatus, a method for adjusting deviation of a print position for the recording apparatus, and a computer program product.

BACKGROUND ART

In recent years, an inkjet recording apparatus that performs printing by ejecting ink from a print head has been in widespread use as an apparatus that prints data stored in computers. The inkjet recording apparatus used as an image recording apparatus, such as a printer, a facsimile machine, a copier, or a plotter, includes an inkjet head. The inkjet head includes a nozzle for ejecting ink droplets, an ink passage (also referred to as an ejection chamber, a pressure chamber, a pressurized-liquid chamber, or a liquid chamber) communicating with the nozzle, and an energy generating unit for generating energy for pressurizing ink in the ink passage. The energy generating unit is driven to eject ink droplets from the nozzle that is pressurizing ink in the ink passage, whereby an image is recorded.

As an inkjet head used in the inkjet recording apparatus, a piezoelectric inkjet head is known, in which a piezoelectric element is used as the energy generating unit that generates energy for pressurizing ink in the ink passage and which ejects ink droplets by deforming a vibration plate, which forms a wall surface of the ink passage, by the piezoelectric element.

An electrostatic inkjet head is also known, in which a vibration plate, which forms a wall surface of the ink passage, and an electrode are arranged in parallel as the energy generating unit and which ejects ink droplets by changing the internal volume of the ink passage by deforming the vibration plate by electrostatic force generated between the vibration plate and the electrode.

One type of the inkjet recording apparatus is configured to move a print head back and forth relative to a printing medium in a main-scanning direction (a direction perpendicular to the moving direction of the printing medium), and eject ink for a plurality of colors with either forward movement or backward movement to thereby form dots on the printing medium (one-directional printing). Another type of the inkjet recording apparatus is configured to form dots on the printing medium with both of the forward movement and the backward movement in the main-scanning direction in order to improve print speed (bidirectional printing).

As one feature of the inkjet recording apparatus, an inkjet recording head may be formed as a line head that is in the form of a long shape with a length corresponding to the maximum print width of a recording medium and that is fixed to a main body of the apparatus. With this configuration, it is not necessary to move the inkjet recording head in the main-scanning direction and it is possible to perform image formation only by conveying the recording medium in a sub-scanning direction perpendicular to the main-scanning direction. Therefore, high-speed image formation is possible.

In the inkjet recording apparatuses as above, when a plurality of nozzles is arranged at different positions in the main-scanning direction in order to print high-quality images on printing media, ink ejection timing is adjusted so that dots can be formed at respective predetermined positions.

Further, when bidirectional printing is performed, ink ejection timing is adjusted so that dots formed with the forward movement in the main-scanning direction (hereinafter, referred to as forward dots) and dots formed with the backward movement (hereinafter, referred to as backward dots) can be formed at respective predetermined positions. The timing is adjusted by using a predetermined test pattern.

For example, a technology for modifying a recording pattern so that a user can easily judge the pattern by visual contact has been disclosed (see Japanese Patent No. 4296043).

FIG. 14 illustrates a test pattern for performing conventional dot-deviation adjustment. The test pattern is used for adjusting deviation of formation positions between the forward dots and the backward dots in the bidirectional printing. The test pattern shown in FIG. 14 is formed of recording patterns that are formed by arranging a plurality of vertical ruled lines in parallel at predetermined intervals. The recording patterns of the forward dots are printed according to predetermined timing signals. The recording patterns of the backward dots with recording pattern numbers 0, +1, +2, . . . , are printed according to predetermined timing signals that are shifted from the respective predetermined timing signals for the forward dots in a stepwise manner.

The recording patterns of the forward dots and the recording patterns of the backward dots are printed so that they overlap each other at a certain position in the main-scanning direction (in FIG. 14, the recording pattern with the recording pattern number 0). In the recording patterns with the numbers +1 and +2, because a timing for driving the print head for the backward dots is advanced, the backward dots are deviated to one side (right in FIG. 14) where the dots land preceding the recording patterns of the forward dots. In the recording patterns with the numbers −1 and −2, because a timing for driving the print head for the backward dots is gradually delayed, the backward dots are deviated to another side (left in FIG. 14) where the dots land following the recording patterns of the forward dots. A user selects the number of the recording pattern in which positions of the recording patterns optimally match each other ("0" in FIG. 14), and performs adjustment to eject ink at a print-head driving timing corresponding to the recording pattern number.

However, with the conventional test pattern shown in FIG. 14, there is a problem in that it is difficult to distinguish a difference between adjacent recording patterns (e.g., the recording patterns with the numbers 0 and +1 in FIG. 14) and accuracy for adjusting relative deviation of dot formation positions is inadequate.

This problem occurs because the difference between the adjacent recording patterns exactly corresponds to adjustment accuracy needed by the recording apparatus and the difference is usually very small. Recent inkjet recording apparatuses increasingly have high resolution, and high adjustment accuracy is desired accordingly. Therefore, it is increasingly difficult to distinguish a difference between adjacent recording patterns.

In the technology disclosed in Japanese Patent No. 4296043, because the visually distinguishable range is targeted, it is difficult to perform adjustment with accuracy to the extent that cannot be determined by visual contact when the printing accuracy with higher resolution and higher fineness is desired.

There is another problem in that, as shown in FIG. 15, even when a difference between adjacent recording patterns is large enough to be distinguished by visual contact, if one of the patterns is deviated in the + direction and the other one of the patterns is deviated in the – direction by the same amount, it is difficult to determine which recording pattern should be selected.

When bidirectional printing is performed in the inkjet recording apparatus, even a slight deviation of dot formation positions largely affects the image quality. For example, assuming that a print head that moves in the main-scanning direction tends to form dots at positions deviated to the left from designated positions with the forward movement, the print head forms dots at positions deviated to the right from designated positions with the backward movement. In this manner, the inkjet recording apparatus that cannot fully adjust dot formation positions lead to increase in degradation of image quality. More specifically, when formation positions of a plurality of dots are relatively deviated from one another, surface roughness occurs on a formed image, leading to decrease in the image quality. The above problem also occurs when dots are formed with either the forward movement or the backward movement.

The present invention has been made in view of the above, and it is an object of the present invention to enable to adjust deviation of a print position between dots, which are printed and formed at different timings, by an easy determination method and with good accuracy.

DISCLOSURE OF INVENTION

According to an aspect of the present invention, there is provided a recording apparatus that includes a recording unit that records an image on a recording medium by causing at least one print head, which includes a plurality of nozzles for ejecting ink, to perform scanning; an adjustment-chart output unit that outputs an adjustment chart containing a plurality of recording patterns, wherein the recording patterns are used for adjusting deviation of a print position between a first dot and a second dot, the dots being printed to form images on the recording medium at different timings by using the print head, and the recording patterns are arranged such that respective deviation amounts with respect to a reference pattern differ from one another; and an ejection-position adjusting unit that adjusts an ejection position of the print head based on an adjustment value that is calculated from a deviation amount of a recording pattern selected from the plurality of the recording patterns. The adjustment chart contains M number of pattern groups, each containing a plurality of recording patterns, where M is an integer equal to or greater than 2, and the recording patterns contained in the same group pattern have respective deviation amounts that are different by M-times of the recording density from minimum deviation amounts that other recording patterns have.

BEST MODE(S) FOR CARRYING OUT THE INVENTION

Exemplary embodiments of a recording apparatus, a method for adjusting deviation of a print position by the recording apparatus, and a computer program will be described in detail below with reference to the accompanying drawings.

Embodiment

Figure 1:
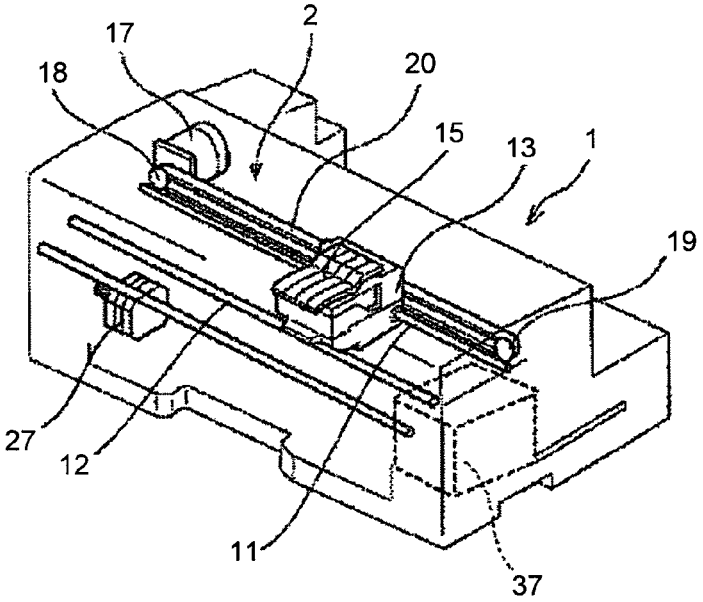
FIG. 1 is a perspective view of a main structure of an inkjet recording apparatus according to an embodiment.

A configuration of an inkjet recording apparatus according to an embodiment of the present invention will be described below with reference to FIG. 1 and FIG. 2. FIG. 1 is a perspective view of a main structure of the inkjet recording apparatus (hereinafter, simply referred to as a recording medium as appropriate) according to the embodiment, and FIG. 2 is a side view of the inkjet recording apparatus shown in FIG. 1.

The inkjet recording apparatus houses, inside an apparatus main body 1, a print mechanical unit 2 that includes a carriage that is movable in the main-scanning direction; a print head that is formed of inkjet heads mounted on the carriage; and a sub tank that supplies ink to the print head. A feed cassette 4 (or a feed tray is also applicable), on which a plurality of sheets 3 can be stacked from the front side, is detachably attached to the bottom of the apparatus main body 1. A manual feed tray 5 for manually feeding the sheets 3 can be unfolded to lie flat. The sheets 3 fed from the feed cassette 4 or the manual feed tray 5 are taken into the inside of the apparatus, a required image is printed by the print mechanical unit 2, and the sheets 3 are discharged to a discharge tray 6 attached to the rear side of the apparatus.

Figure 2:
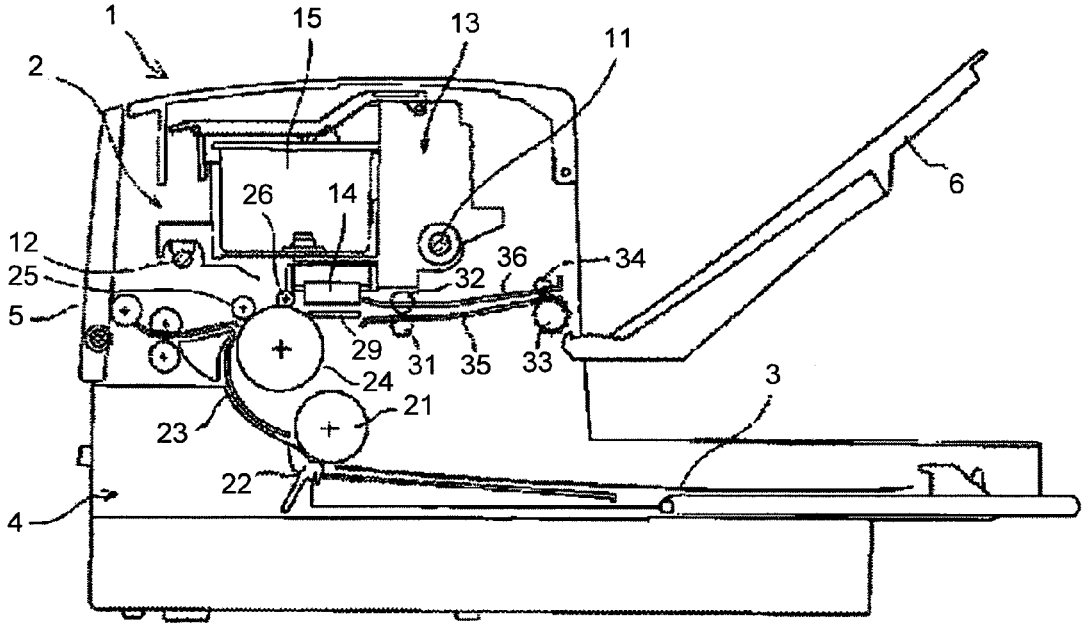
FIG. 2 is a side view of the inkjet recording apparatus shown in FIG. 1.

The print mechanical unit 2 slidably holds a carriage 13 by using a main guide rod 11 and a sub guide rod 12 in the main-scanning direction (a direction normal to a page surface of FIG. 2). Print heads 14 formed of inkjet heads for ejecting ink droplets for respective colors of yellow (Y), cyan (C), magenta (M), and black (K) are mounted on the carriage 13 such that a plurality of ink ejection ports is arranged in a cross direction with respect to the main-scanning direction and ink-droplet ejection direction becomes a downward direction. Sub tanks 15 for supplying ink for respective colors to the print heads 14 are mounted on the carriage 13.

Each sub tank 15 includes an air port arranged on the top side for communicating with air, a supply port arranged on the bottom side for supplying ink to the inkjet heads, a sensor arranged inside for detecting remaining amount of ink, and a porous body filled with ink. Due to the capillary force of the porous body, ink to be supplied to the inkjet heads is maintained at negative pressure. The volume of the sub tanks 15 of the embodiment is limited to requisite minimum in order to reduce weight of the carriage 13 for speeding up the printer. Therefore, when the ink in the sub tanks 15 is reduced, it is necessary to supply ink.

The print heads for respective colors are used as the print heads 14; however, a single print head having nozzles for ejecting respective ink droplets may be applied. Further, the inkjet head used as the print head 14 may be, as a discharging mechanism, a piezoelectric inkjet head that pressurizes ink by an electromechanical transduction element, such as a piezoelectric element, via a vibration plate that forms a wall surface of a liquid chamber, a thermal inkjet head that includes a heating element that produce heat by being electrically charged and that uses film boiling, or an electrostatic inkjet head that pressurizes ink by deforming a vibration plate by electrostatic force between the vibration plate that forms a wall surface of an ink passage and an electrode facing the vibration plate. In the embodiment, explanation is given with use of a piezoelectric inkjet head.

As shown in FIG. 1, the rear side (the downstream side in a sheet conveying direction) of the carriage 13 is slidably fitted into the main guide rod 11 and the front side (the upstream side in the sheet conveying direction) of the carriage 13 is slidably placed on the sub guide rod 12. In order to move the carriage 13 in the main-scanning direction for scanning, a timing belt 20 is extended between a driving pulley 18 that is driven to rotate by a main-scanning motor 17 and a driven pulley 19. The timing belt 20 is fixed to the carriage 13 and the carriage 13 is driven back and forth along with normal rotation and reverse rotation of the main-scanning motor 17.

In order to convey the sheets 3 set in the feed cassette 4 to the under side of the print heads 14, there are provided a feed roller 21 and a friction pad 22 that separate and feed the sheet 3 from the feed cassette 4; a guide member 23 that guides the sheet 3; a conveying roller 24 for inverting and conveying the sheet 3 that has been fed; a conveying roller 25 that is pressed against the peripheral surface of the conveying roller 24; and a leading-end roller 26 that defines a feed angle for feeding the sheet 3 from the conveying roller 24. The conveying roller 24 is driven to rotate by a sub-scanning motor 27 via a gear train.

An imaging receiving member 29 is provided as a sheet guide member for guiding the sheet 3 conveyed by the conveying roller 24 on the under side of the print heads 14 in accordance with a moving range of the carriage 13 in the main-scanning direction. A conveying roller 31 and a spur 32, which are driven to rotate for conveying the sheet 3 in a sheet discharge direction, a conveying roller 33 and a spur 34, which convey the sheet 3 to the discharge tray 6, and guide members 35 and 36, which form a sheet discharge pass, are arranged on the downstream side of the imaging receiving member 29 in the sheet conveying direction.

When an image is recorded on the sheet 3, the print heads 14 are driven according to a printing signal while moving the carriage 13. Accordingly, ink is ejected onto the sheet 3, which is stopped, such that recording for one line is performed with the forward movement and recording for a next line is performed with the backward movement after moving the sheet 3 by a predetermined amount (hereinafter, referred to as bidirectional printing).

Upon reception of a recording end signal or a signal indicating that the trailing end of the sheet 3 reaches a recording area, the recording operation ends and the sheet 3 is discharged. The recording on the sheet may be one-directionally performed with either the forward movement or the backward movement (hereinafter, referred to as one-directional printing).

When images recorded by the bidirectional printing or the one-directional printing are deviated from each other, a predetermined adjustment chart is output to set an adjustment value. An adjustment method using the adjustment chart will be described below.

A recovery device 37, which is formed of main ink tanks for supplying ink to the sub tanks 15, is disposed at a position out of the recording area on the left end side of the carriage 13 in the moving direction. The recovery device 37 includes a capping unit, a suction unit, a cleaning unit, and an ink supply unit. The carriage 13 is moved to the recovery device 37 side when the carriage is on standby for printing. At this time, the print heads 14 are capped with the capping unit so that the ejection ports can be maintained in wet states in order to prevent ejection failure due to drying of ink. Further, ink that is not related to recording is ejected during recording so that the viscosity of ink at all of the ejection ports can be made constant in order to maintain stable ejection performance.

When ejection failure occurs, the capping unit seals the ejection ports of the print heads 14, the suction unit sucks out air bubbles or the like together with ink from the ejection ports via a tube, and the cleaning unit removes ink, foreign particles, and the like attached to the ejection port surfaces, whereby the ejection failure can be recovered. The sucked ink is discharged to a waste ink reservoir (not shown) set on the bottom portion of the apparatus main body 1, and is absorbed into ink absorbers inside the waste ink reservoir.

When the ink in the sub tanks 15 is used up, ink is supplied by the recovery device 37 when the carriage 13 reaches a predetermined position. The recovery device 37 having ink tanks for four different colors of yellow (Y), magenta (M), cyan (C), and black (K) is directly connected to the sub tanks 15 for Y, M, C, and K, respectively, via tubes or the like, and is always applied with constant hydraulic pressure. The recovery device 37 is equipped with an ink supply nozzle and a valve such that the valve is opened and ink flows out from the ink supply nozzle when ink needs to be supplied, which allows for supply of ink to the sub tank 15.

Described below is adjustment of deviation of a print position, which is performed by the inkjet recording apparatus configured as above when an image recorded with the forward movement and an image recorded with the backward movement are deviated from each other upon the bidirectional printing.

By printing a predetermined adjustment chart and setting an adjustment value, it is possible to adjust image deviation. The adjustment is also possible in the one-directional printing.

The inkjet recording apparatus according to the embodiment includes at least one print head having a plurality of nozzles for ejecting ink, a moving unit that moves the print head, and a conveying unit that conveys a printing medium. In the inkjet recording apparatus, an adjustment chart is printed on the printing medium for adjusting deviation of formation positions between the first dots and the second dots, which form images on the printing medium by the print head at different timings.

The adjustment chart printed by the inkjet recording apparatus is formed using at least one color, and the adjustment chart is formed of a plurality of adjustment patterns. The plurality of adjustment patterns that form the adjustment chart are formed as follows. Printing is performed in the conveying direction of the printing medium while skipping some of the nozzles arranged on the print head such that at least one or more lines are printed in the moving direction of the print head, and then at least one or more blank lines are formed as one set. The printing is performed a predetermined number of times with the set of at least one or more blank lines formed at regular intervals. The reason for skipping some of the nozzles is to suppress occurrence of printing dots and reduction in visibility caused by ink bleed. The reason for performing printing at regular intervals in the moving direction of the print head is to average the speed fluctuation or unevenness in the printing in the moving direction of the print head, and improve accuracy and visibility.

Figure 3:
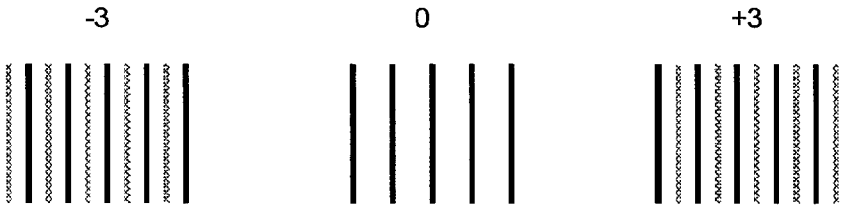
FIG. 3 is an explanatory diagram of an example in which adjustment patterns are recorded so as to be deviated in a stepwise manner.
Figure 3:
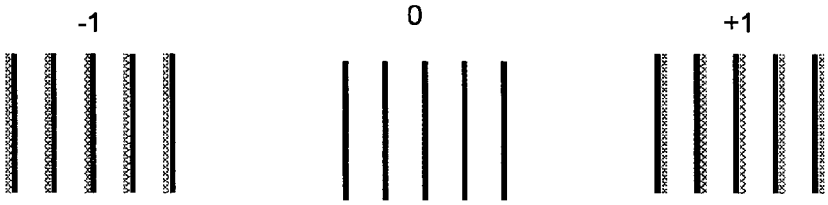
Figure 4:
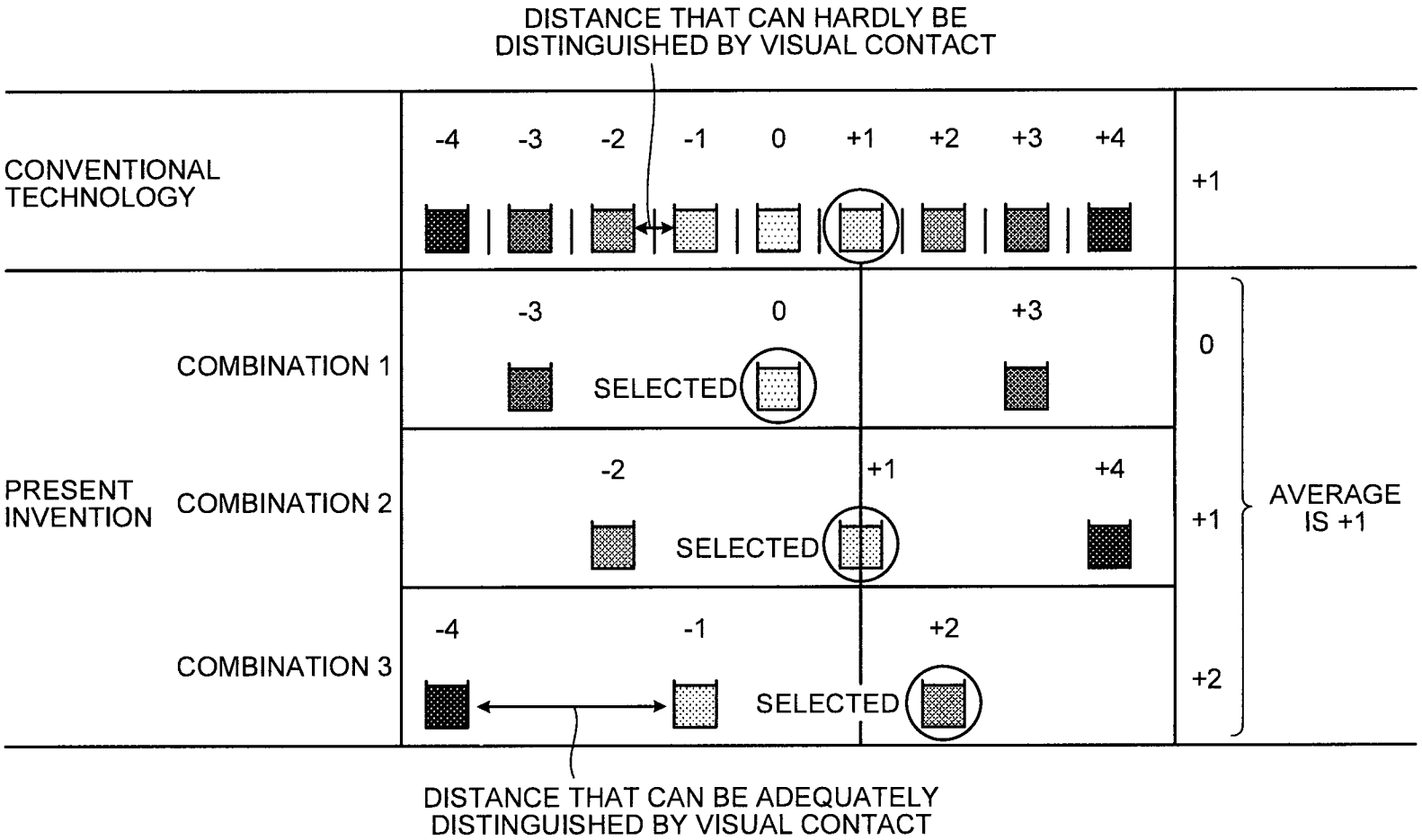
FIG. 4 is an explanatory diagram for explaining that a difference in a deviation amount between adjustment patterns is greater than recording resolution.
Figure 5:
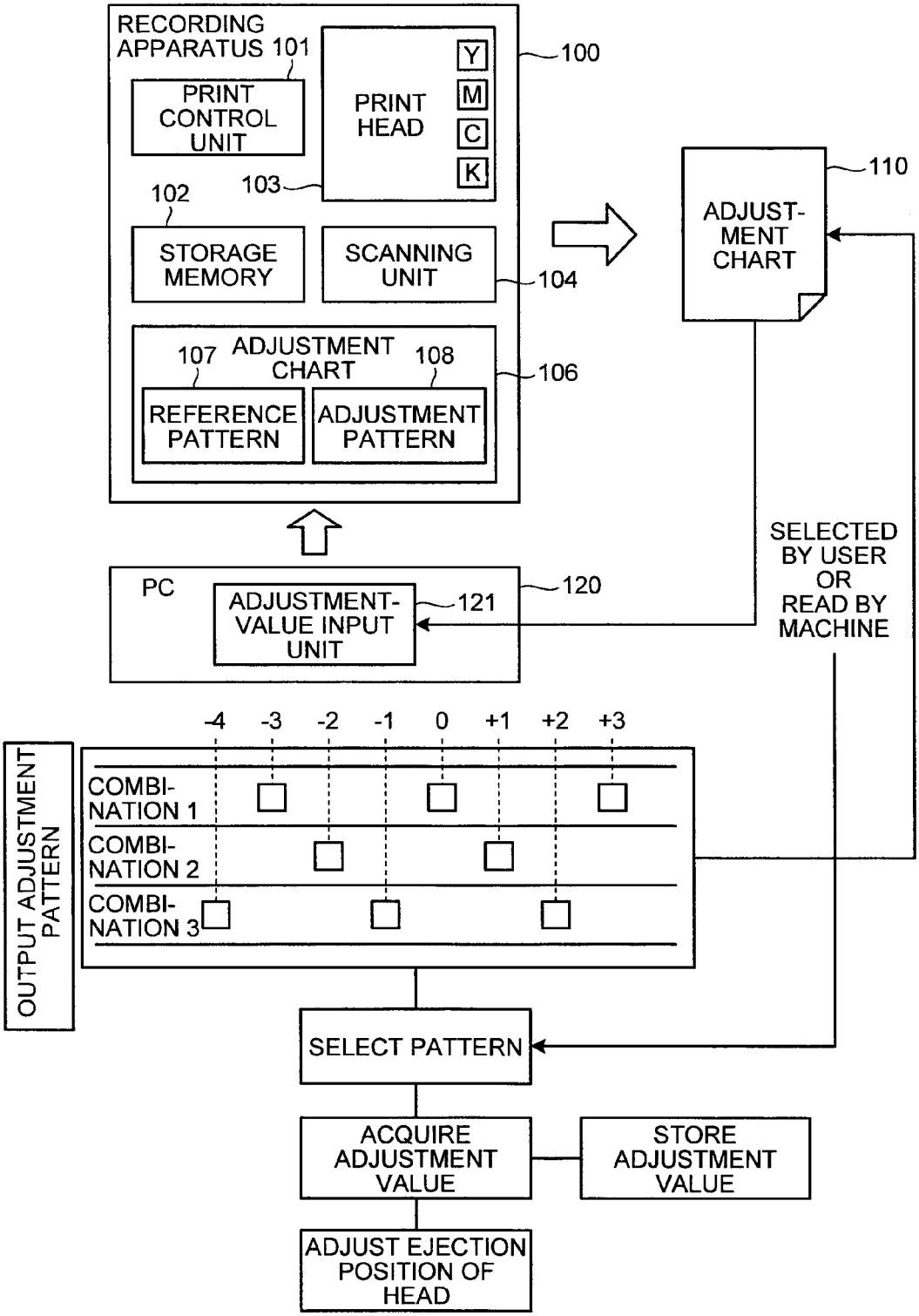
FIG. 5 is a block diagram of a configuration of the recording apparatus for adjusting print positions according to the present invention.
Figure 6:
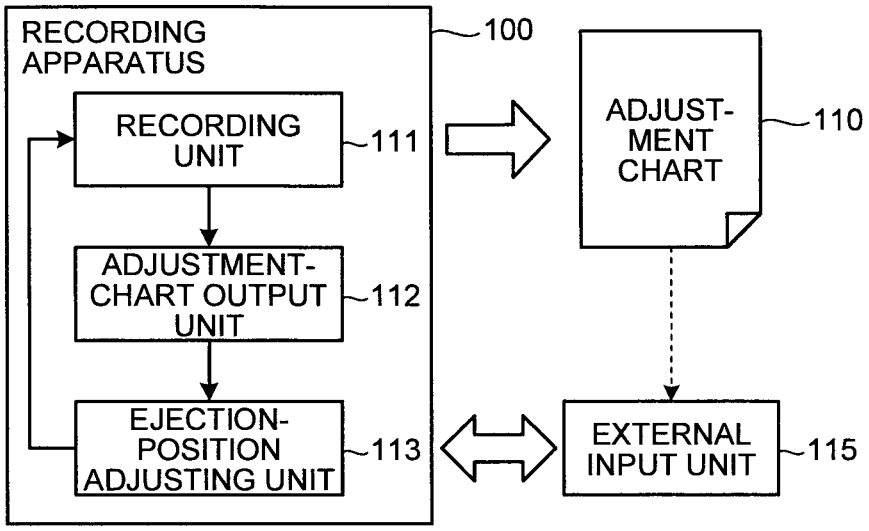
FIG. 6 is a block diagram of a functional configuration of the recording apparatus according to the present invention.

The method for adjusting deviation of a print position, which is a feature of the present invention, will be described in detail below with reference to drawings. FIG. 3 is an explanatory diagram of an example in which adjustment patterns are recorded so as to be deviated in a stepwise manner. FIG. 4 is an explanatory diagram for explaining that a difference in a deviation amount between adjustment patterns is greater than recording resolution. FIG. 5 is a block diagram of a configuration of the recording apparatus for adjusting print positions according to the present invention. FIG. 6 is a block diagram of a functional configuration of the recording apparatus according to the present invention.

In FIG. 5, reference numeral 100 denotes a recording apparatus, reference numeral 101 denotes a print control unit that performs various control including print control by the recording apparatus 100, reference numeral 102 denotes a storage memory, reference numeral 103 denotes a print head, reference numeral 104 denotes a scanning unit, reference numeral 106 denotes adjustment chart data, reference numeral 107 denotes reference pattern data, reference numeral 108 denotes adjustment pattern data, reference numeral denotes an adjustment chart, reference numeral 120 denotes a personal computer (hereinafter, appropriately referred to as PC), and reference numeral 121 denotes adjustment-value input unit.

The recording apparatus 100 corresponds to the inkjet recording apparatus shown in FIGS. 1 and 2. The print control unit 101 is formed of a microcomputer system including a CPU, a ROM, a RAM, a timer, and the like, and performs overall control of the recording apparatus 100. The print heads 103 corresponds to the print heads 14 shown in FIG. 2. The scanning unit 104 corresponds to a drive motor and a drive mechanism including the carriage 13 shown in FIG. 1. The storage memory 102 stores various parameters in a readable and writable manner. The adjustment chart 106 is memory data having the reference pattern data 107 and the adjustment pattern data 108. The data of the adjustment chart 106 may be stored in the storage memory 102, or may be provided in the personal computer 120.

In the functional block diagram of FIG. 6, a recording unit 111 is a function implemented by the print mechanical unit 2 shown in FIG. 2. The recording unit 111 causes at least one print head 103 that includes a plurality of nozzles for ejecting ink to perform scanning to thereby record images on recording media.

An adjustment-chart output unit 112 outputs the adjustment chart 110 for adjusting deviation of a print position between the first dots and the second dots, which form images on a recording medium at different timings by using the print heads 103.

An ejection-position adjusting unit 113 obtains an adjustment value based on the deviation amount of a recording pattern selected from a plurality of recording patterns contained in the adjustment chart output by the adjustment-chart output unit 112, sets the adjustment value as a new adjustment value, and then adjust ejection position of the print heads 103.

The external input unit 115 is a function implemented by the personal computer 120 that is connected to the recording apparatus 100 in a manner allowing for mutual data communication.

Figure 11:
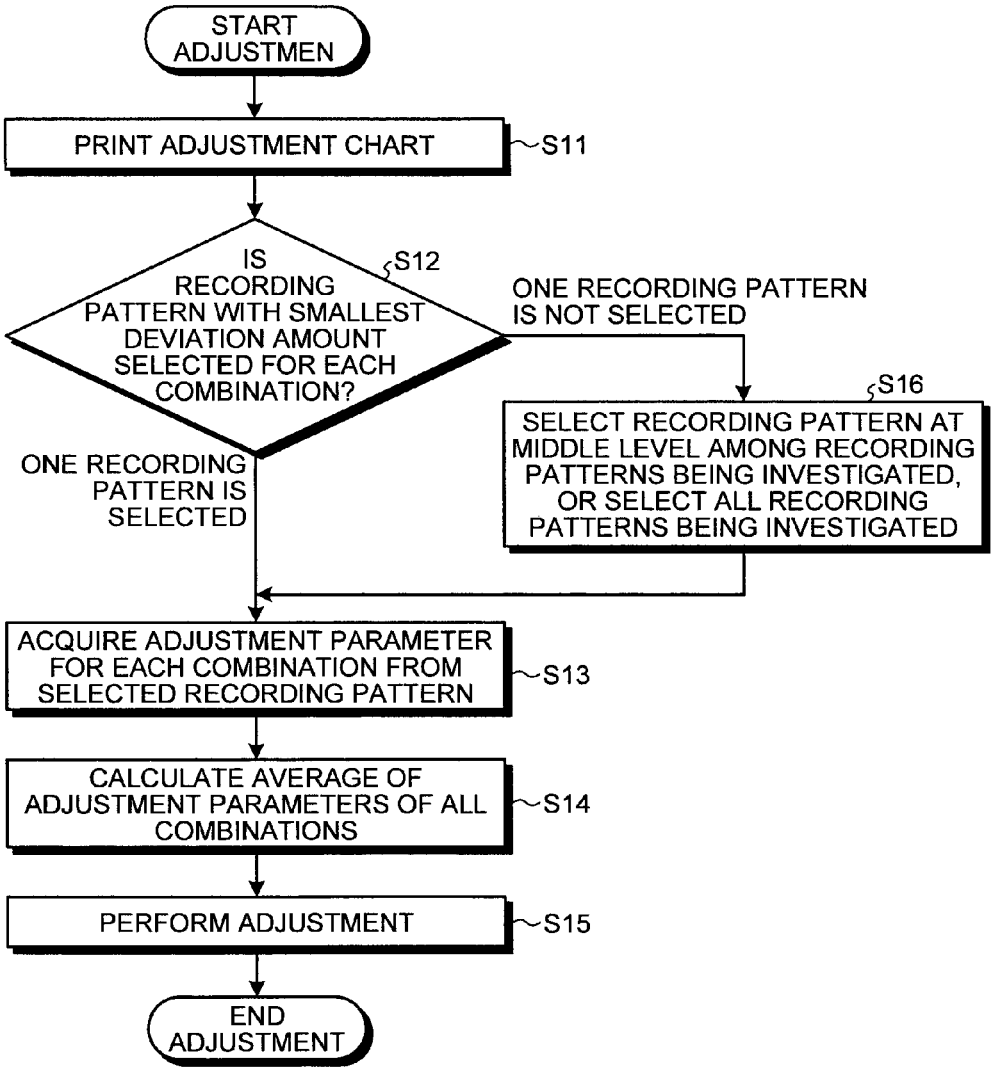
FIG. 11 is a flowchart of a series of operations of a method for adjusting deviation of a print position according to the embodiment.
Figure 12:
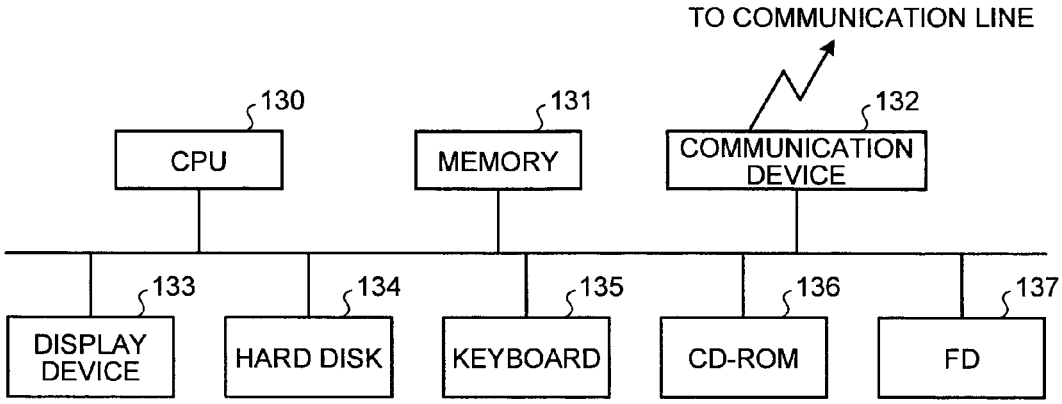
FIG. 12 is a block diagram of a configuration example for causing a computer to execute a control processing program according to the embodiment.

A flow of the method for adjusting deviation of a print position will be described below. FIG. 11 is a flowchart of an exemplary control procedure of the method for adjusting deviation of a print position according to the embodiment. The control procedure is executed by the print control unit 101 of the recording apparatus 100. The adjustment chart 110 is printed by using the adjustment chart 106 (Step S11). At this time, the adjustment chart 110 is formed of a reference adjustment pattern and a plurality of combinations of recording patterns at print positions deviated from the reference adjustment pattern in a stepwise manner.

Subsequently, it is determined whether a recording pattern with the smallest deviation amount is selected for each combination from the printed adjustment chart 110 (Step S12). More specifically, it is determined whether input is made by a user about whether one recording pattern with the smallest deviation amount can be selected by visual contact. When one recording pattern is selected, an adjustment parameter for each combination is acquired from the selected recording pattern (Step S13). Then an average of the adjustment parameters of all of the combinations is calculated (Step S14), and performs adjustment (Step S15). When one recording pattern is not selected from the printed adjustment chart 110 at Step S12, a recording pattern at middle level among a plurality of recording patterns being investigated or all of the recording patterns being investigated is selected (Step S16), and the process at Step S13 or later is performed. The above operations will be described in detail below.

Figure 14:
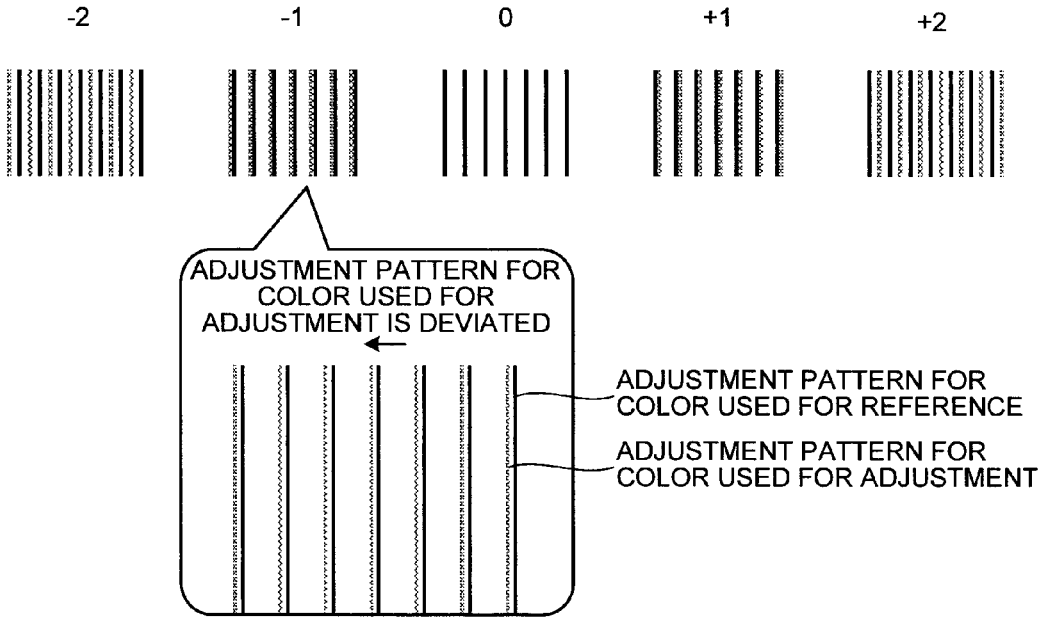
FIG. 14 is an explanatory diagram of an example of adjustment patterns that are printed to be deviated per dots.
Figure 15:
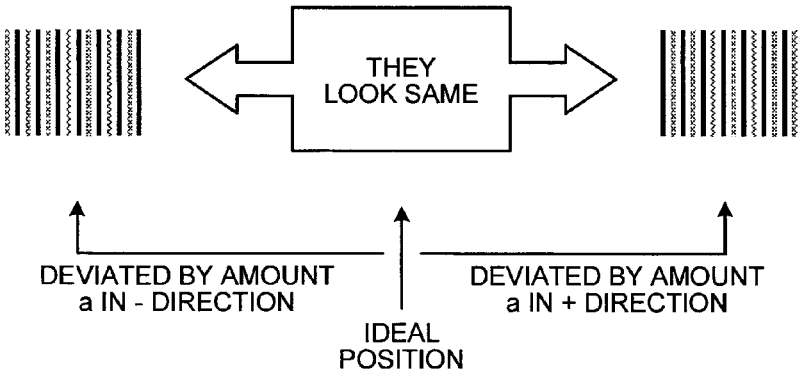
FIG. 15 is an explanatory diagram of an example for adjusting deviation of a print position by using the printed adjustment patterns shown in FIG. 14.

The adjustment chart 110 is explained first. Adjustment patterns for color used for reference for adjusting deviation of a print position and adjustment patterns for color used for adjustment for adjusting deviation of a print position are formed such that, as shown in FIG. 14, a plurality of the adjustment patterns for color used for reference for adjusting deviation of a print position is arranged at regular intervals in the moving direction of the print head 103, and the adjustment patterns for color for adjustment are printed so as to be deviated in a stepwise manner in the moving direction of the print head 103. At this time, the adjustment patterns for color used for reference and the adjustment patterns for color used for adjustment may have the same pattern structures or different pattern structures.

As shown in the upper part of FIG. 3, a difference in the amount of stepped deviation is M-times greater than the recording resolution of the recording apparatus 100 (M is an integer equal to or greater than 2, and 3 in FIG. 3). This is because a deviation amount equal to the recording resolution results in only a slight difference as shown in the lower part of FIG. 3, and it is difficult to distinguish a plurality of recording patterns that are deviated in a stepwise manner.

A difference in the amount of stepped deviation (stepped difference) varies depending on the recording resolution. For example, when the deviation is to be determined by visual contact by a person, because a difference of about 100 μm or more, which may vary depending on the structure of a recording pattern, allows the determination, it is desirable to set a stepped difference of about 2 dots (about 168 μm) with respect to the recording resolution of 300 dpi, a stepped difference of about 3 dots (about 126 μm) with respect to the recording resolution of 600 dpi, and a stepped difference of about 5 dots (about 105 μm) with respect to the recording resolution of 1200 dpi.

When read of patterns of the adjustment chart 110 is performed with automatic determination by an optical machine such as a scanner, it is desirable to change the stepped deviation depending on the measurement accuracy of the machine.

A plurality of recording patterns that are deviated in a stepwise manner are combined, and an adjustment value corresponding to a recording pattern, in which the deviation of a recording position is the smallest between the adjustment pattern for color used for reference for adjusting deviation of a print position and the adjustment pattern for color used for adjustment for adjusting deviation of a print position, among the combinations is used as one adjustment parameter.

The adjustment value at this time is an adjustment value for correcting the deviation amount in the recording pattern in which the deviation amount between print positions is the smallest.

Figure 10:
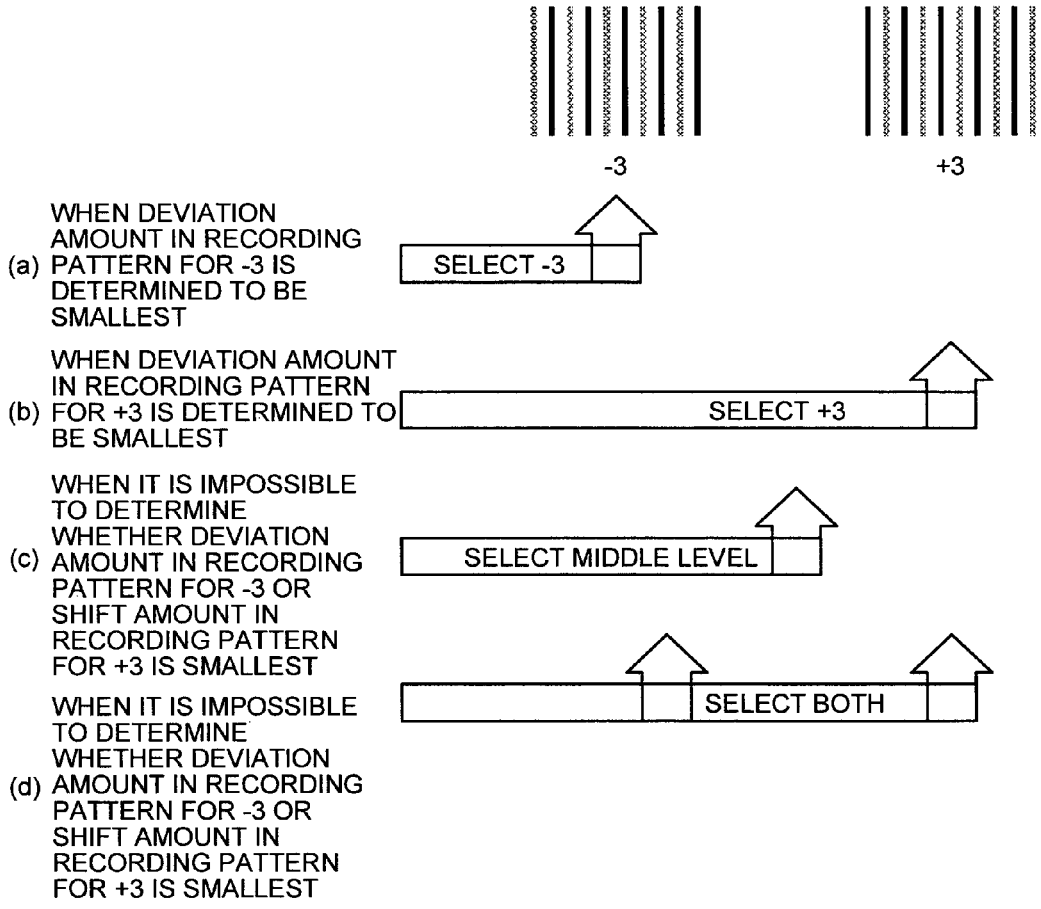
FIG. 10 is an explanatory diagram illustrating the states in which deviation amounts are selected for respective printed adjustment patterns.

FIG. 10 is an explanatory diagram of examples about what recording pattern is to be selected. FIG. 10(*a*) is an example of selection when the deviation amount in the recording pattern for −3 is determined to be the smallest. FIG. 10(*b*) is an example of selection when the deviation amount in the recording pattern for +3 is determined to be the smallest. FIG. 10(*c*) is an example (1) of selection when it is impossible to determine whether the deviation amount in the recording pattern for +3 and the deviation amount in the recording pattern for −3 is the smallest. FIG. 10(*d*) is an example (2) of selection when it is impossible to determine whether the deviation amount in the recording pattern for +3 and the deviation amount in the recording pattern for −3 is the smallest.

When selecting a recording pattern, in which the deviation of a print position is the smallest between the adjustment pattern for color used for reference for adjusting deviation of a print position and the adjustment pattern for color used for adjustment for adjusting deviation of a formation position, from among the combinations in the adjustment chart 110 that has been output, and if the deviation amount of the print position is determined to be the same between a plurality of recording patterns and it is difficult to select a recording pattern having the smallest deviation amount as shown in FIG. 10(*c*), it may be possible to select a middle position of the plurality of recording patterns, of which deviation amounts of the print position is determined to be identical, and to apply a corresponding intermediate value as one adjustment parameter.

The intermediate value at this time is an average of the adjustment values, which are used for correcting the deviation amount in the respective recording patterns that are determined to have the same deviation amount of the print position.

Further, when selecting a recording pattern, in which the deviation of a print position is the smallest between the adjustment pattern for color used for reference for adjusting deviation of a print position and the adjustment pattern for color used for adjustment for adjusting deviation of a formation position, from among the combinations, and if the deviation amount of the print position is determined to be the same between a plurality of recording patterns and it is difficult to select a recording pattern having the smallest deviation amount as shown in FIG. 10(*d*), it may be possible to select all of the recording patterns that are determined to have the same deviation amount of the print position and obtain corresponding one adjustment parameter.

The adjustment parameter at this time is an average of the adjustment values, which are used for correcting the deviation amount in the respective recording patterns that are determined to have the same deviation amount of the print position.

A plurality of adjustment parameters obtained as above is obtained from the respective combinations of the recording patterns, and an average of the adjustment parameters is calculated. This is performed in order to obtain the same result as is obtained by fine adjustment performed with the recording resolution, by performing rough adjustment for selecting candidates with greater accuracy than the recording resolution multiple times as shown in FIG. 4. Assuming that an average of N adjustment parameters is AVE_PN and an i-th adjustment parameter is Pi, the average is calculated according to the following Equation.

$$AVE_PN = 1/N \times \Sigma Pi \ (i=1 \text{ to } N)$$

In the example shown in FIG. 4, "0" is selected from "−3, 0, +3" in the combination 1 of FIG. 4, "+1" is selected from "−2, +1, +4" in the combination 2, and "+2" is selected from "−4, −1, +2" in the combination 3. Therefore, the average of these adjustment parameters is "+1" as follows.

$$\tfrac{1}{3} \times (0+1+2) = +1$$

For performing the rough adjustment multiple times, a distance greater than the accuracy that is ultimately desired for adjustment is set, and the distance is used as a unit of the deviation amount between the adjustment pattern for reference and the adjustment pattern for adjustment. The deviation amount is changed in a stepwise manner in this unit, so that a recording pattern formed of a plurality of adjustment patterns of which deviation amounts are changed by this unit is formed. Further, a plurality of combinations (recording patterns) are recorded with deviation of the amount corresponding to the accuracy desired for adjustment, so that pattern groups as shown in FIG. 4 are formed.

The adjustment of a formation position is performed, as adjustment for correcting the deviation amount of a print position between color used for reference for adjusting deviation of a print position and color used for adjustment for adjusting deviation of a print position.

Figure 7:
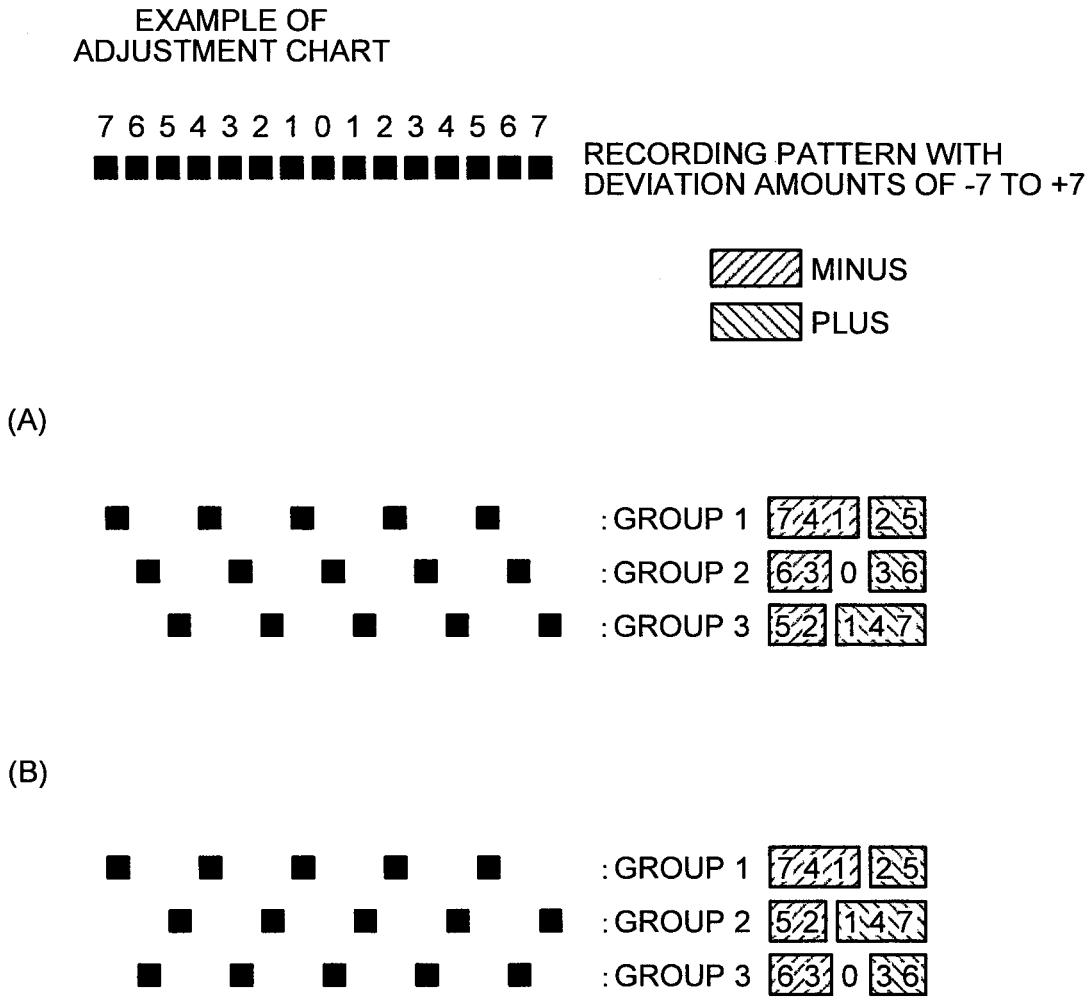
FIG. 7 is a diagram of an example of an adjustment chart.

FIG. 7 is a diagram of an example of the adjustment chart. The upper part of FIG. 7 illustrates an example of a conventional recording pattern. Black squares in FIG. 7 indicate one recording pattern. Values represent deviation amounts with respect to the reference adjustment pattern. In FIG. 7, the recording pattern with the deviation amounts of −7 to +7 is illustrated.

By dividing the conventional recording pattern into three combinations (groups), where M=3, an adjustment chart form of three pattern groups (group 1, group 2, and group 3), each containing a plurality of recording patterns, is obtained as shown in FIG. 7(A). In each combination, recording patterns of which deviation amounts are shifted per M=3 are recorded. That is, the recording patterns contained in the same pattern group have respective deviation amounts that are different by M (3)-times of the recording density from minimum deviation amounts that the other recording patterns have. The adjustment chart is not limited to this example. For example, an adjustment chart as shown in FIG. 7(B) may be used.

The adjustment chart is printed and a recording pattern is selected for each pattern group by a user. It is possible to select one recording pattern or a plurality of recording patterns. The recording apparatus 100 receives a selection result made by the user, employs an average of the deviation amounts corresponding to the recording patterns selected from the respective pattern groups as an adjustment value, and sets the adjustment value to the ejection-position adjusting unit 113.

For example, when the selection result made by the user is "−1" for the group 1, "0" and "3" for the group 2, and "1" for the group 2, the adjustment value becomes such that (−1+0+3+1)/4=0.75.

Figure 8:
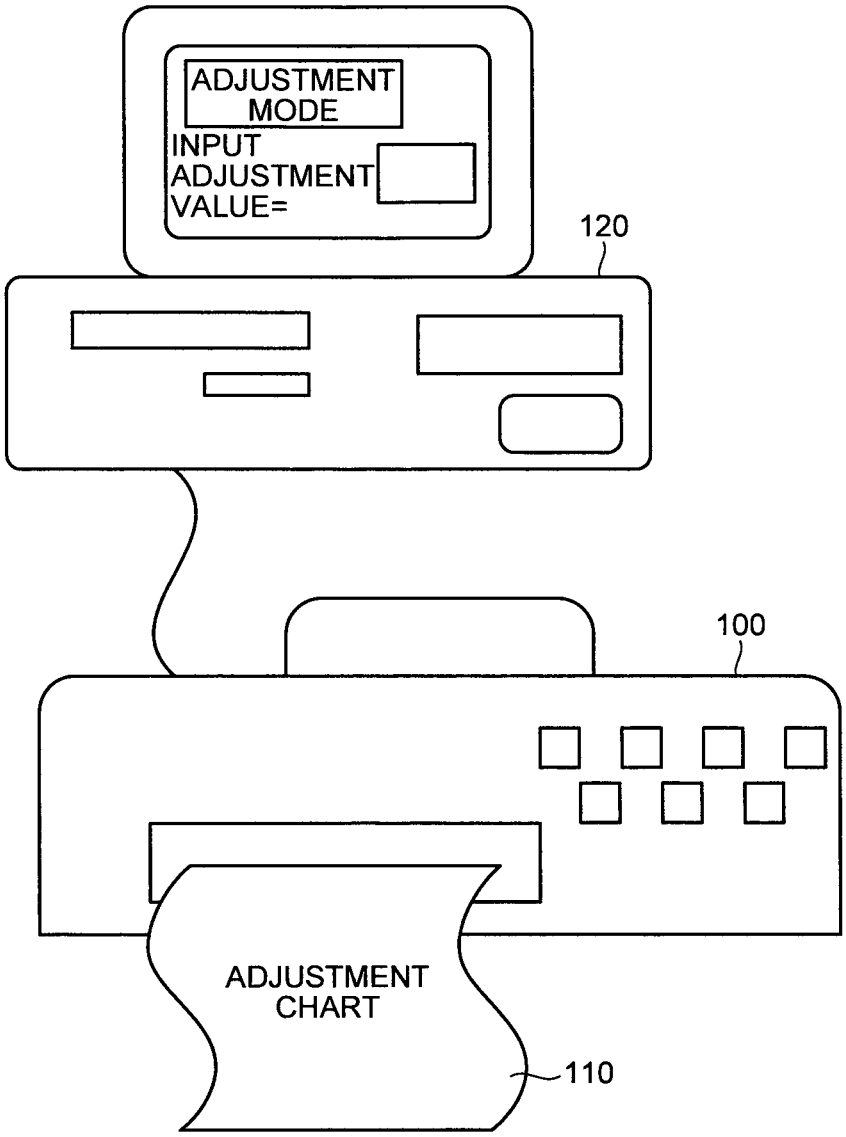
FIG. 8 is an explanatory diagram of an example of a system configuration for adjusting deviation of a print position (print instruction) according to the embodiment.

An operational method for adjusting deviation of a print position will be described below with reference to FIG. 8 and FIG. 9. The deviation of a print position is adjusted by the personal computer 120 and the recording apparatus 100 connected to each other as shown in FIG. 8.

Figure 9:
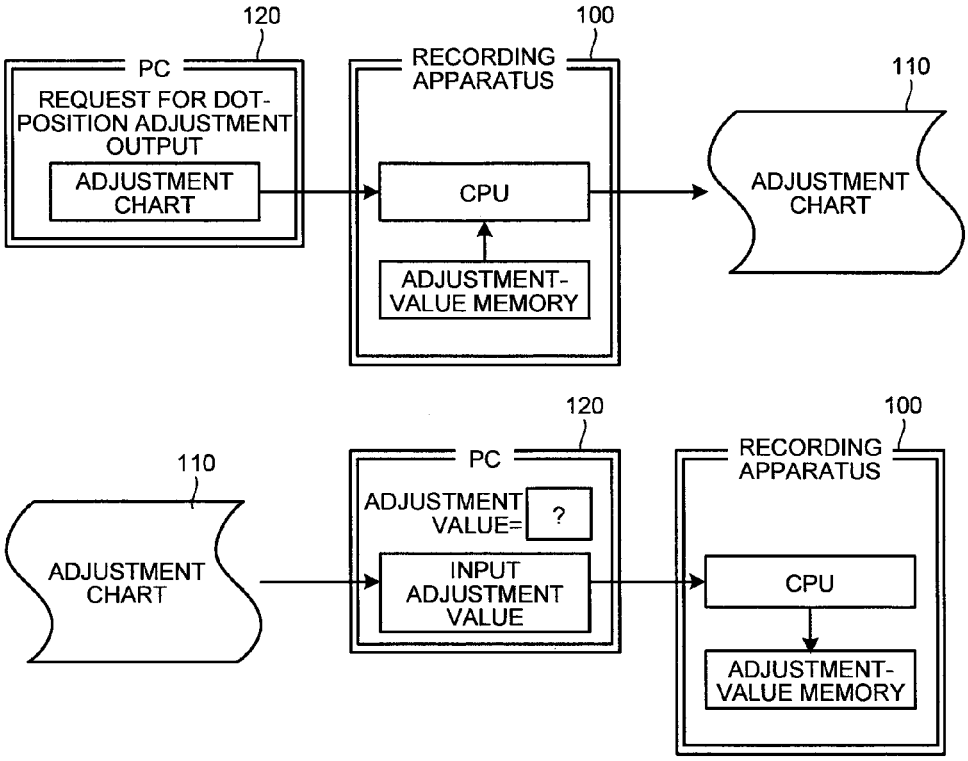
FIG. 9 is an explanatory diagram of an example for adjusting deviation of a print position with the system configuration shown in FIG. 8.

When a user needs to perform dot adjustment based on a printed image (the adjustment chart 110) output by the recording apparatus 100, he/she causes the recording apparatus 100 and the PC 120 to print out the adjustment chart 110 (the upper part of FIG. 9). The user causes the recording apparatus 100 to read an adjustment value from the printed-out adjustment chart 110, and inputs the adjustment value via the adjustment-value input unit 121 of the PC 120 (the lower part of FIG. 9). An adjustment-value entry area is displayed on a display unit of the PC 120, and the user inputs the adjustment value with reference to the adjustment-value entry area. The input adjustment value is stored in the storage memory 102 of the recording apparatus 100 via the PC 120, and deviation of a dot position is adjusted based on an average calculated using the stored adjustment values.

The processing operation of the method for adjusting deviation of a print position according to the embodiment as above may be programmed so that it can be stored in a computer-readable recording medium and executed on the computer. A part of the processing method may be provided on the network and implemented via a communication line.

More specifically, the processing method for the method for adjusting deviation of a print position described in the above embodiment may be implemented by causing a computer (a CPU 130), such as a personal computer or a workstation, to execute a program that is provided in advance. The program is recorded in a computer-readable recording medium, such as a memory 131, a hard disk 134, a flexible disk 137, a CD-ROM (Compact-Disc Read Only Memory) 136, an MO (Magneto Optical), or a DVD (Digital Versatile Disc), and executed by being read from the recording medium by the computer (the CPU 136) and by being appropriately displayed according to need on a display device 133. The data for the processing method may be exchanged between a communication device 132 and an external apparatus according to need.

Figure 13:
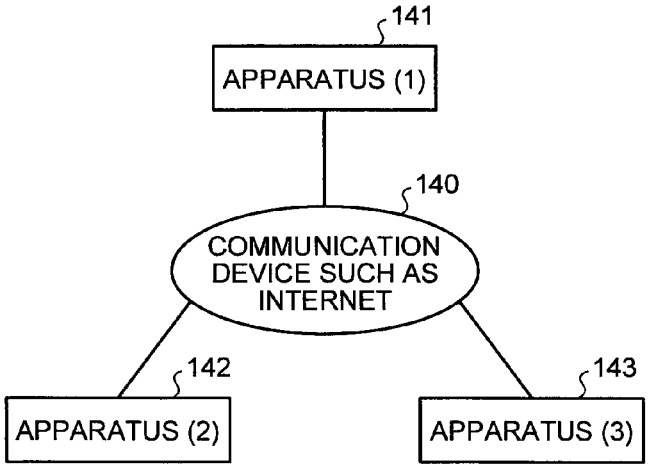
FIG. 13 is a block diagram of a configuration example for distributing the control processing program according to the embodiment via a computer network.

As shown in FIG. 13, the program may be distributed to apparatuses 141 to 143 such as personal computers over a network such as the Internet 140 via the recording medium.

More specifically, the program may be provided by being installed in, for example, a hard disk that is a recording medium built in a computer. The program may be temporarily or permanently stored in a recording medium and built into a computer as a unit or used as a removable recording medium so that it can be provided as package software.

Examples of the recording medium include a flexible disk, a CD-ROM, an MO disk, a DVD, a magnetic disk, and a semiconductor memory.

The program may be transferred to a computer by lines or by radio over a network such as a LAN (Local Area Network) or the Internet, and downloaded onto a built-in storage device, such as a hard disk, in the computer.

As described above, the present invention may be embodied in the form of a program that causes a computer to implement the above adjustment method, or in the form of a computer-readable recording medium storing the program. The program includes a printer driver that can be installed into a computer.

The recording medium that stores therein programs and data for implementing the method for adjusting deviation of a print position according to the present invention may be, for example, a CD-ROM, magneto optical disk, a DVD-ROM, an FD, a flash memory, a memory card, a memory stick, or various other ROMs and RAMs. By causing a computer to execute steps, which are stored in the recording medium and described in the above embodiment, so as to record and distribute the program for implementing the method for adjusting deviation of a print position, the above functions can be easily implemented. The functions of the method for adjusting deviation of a print position according to the present invention can be implemented by attaching the recording medium to an information processing apparatus, such as a computer, and causing the information processing apparatus to read the program as above, or by storing the program in a recording medium included in the information processing apparatus and reading the recording medium according to need.

According to the present invention, it is possible to adjust deviation of a print position between dots, which are printed and formed at different timings, by an easy determination method and with good accuracy.

INDUSTRIAL APPLICABILITY

As described above, a recording apparatus, a method for adjusting deviation of a print position by the recording apparatus, and a computer program product are useful for an inkjet recording apparatus and a method for adjusting deviation of a print position, which is performed by the inkjet recording apparatus. In particular, the present invention is useful for an inkjet recording apparatus that performs one-directional printing or bidirectional printing, a recording apparatus having a line head that is in the form of a long shape with a length corresponding to the maximum print width of a recording medium and that is fixed to a main body of the apparatus, and a method of adjusting deviation of a print position, which is performed by the inkjet recording apparatus.

The invention claimed is:

1. A recording apparatus, comprising:

a recording unit that records an image on a recording medium by causing at least one print head, which includes a plurality of nozzles for ejecting ink, to perform scanning;

an adjustment-chart output unit that outputs an adjustment chart separated into M number of pattern combinations arranged in M number of rows, where M is an integer equal to or greater than 2, each of the M number of pattern combinations containing a plurality of recording patterns having a plurality of dots, used for adjusting deviation of a print position between a respective first dot and a respective second dot among each of the plurality of recording patterns, the plurality of dots of each of the M number of pattern combinations being printed to form images on the recording medium at different positions by using the print head, and each of the plurality of recording patterns are arranged such that respective position deviation amounts of the respective first dot and the respective second dot among each of the plurality of recording patterns differ from one another relative to a reference pattern containing the M number of pattern combinations on a single row; and an ejection-position adjusting unit that adjusts an ejection position of the print head based on an adjustment value that is calculated from a deviation amount of a recording pattern selected from the plurality of the recording patterns, wherein respective deviation amounts between the respective first dot and the respective second dot among each of the plurality of recording patterns are M-times the deviation amount between a corresponding first dot and a corresponding second dot in the reference pattern containing the M number of pattern combinations on the single row.

2. The recording apparatus according to claim 1, wherein the ejection-position adjusting unit calculates the adjustment value from the respective deviation amounts in each of the plurality of recording patterns, the recording patterns being selected from all of the M number of pattern combinations in a one-to-one relation or in a many-to-one relation, and adjusts the ejection position of the print head based on the calculated adjusted value.

3. The recording apparatus according to claim 1, wherein the ejection-position adjusting unit calculates the adjustment value that is an average of deviation amounts in each of the plurality of recording patterns, the recording patterns being selected from all of the M number of pattern combinations in a one-to-one relation or in a many-to-one relation, and adjusts the ejection position of the print head based on the calculated adjusted value.

4. The recording apparatus according to claim 1, wherein the ejection-position adjusting unit calculates the adjustment value that is an average of deviation amounts in each of the plurality of recording patterns, the recording patterns being selected from all of the M number of pattern combinations in a one-to-one relation, and adjusts the ejection position of the print head based on the calculated adjusted value.

5. The recording apparatus according to claim 1, further comprising:

an input unit configured to accept a user selection of at least one pattern combination of the M number of pattern combinations in the adjustment chart.

6. A method for adjusting deviation of a print position for a recording apparatus that includes a recording unit that records an image on a recording medium by causing at least one print head, which includes a plurality of nozzles for ejecting ink, to perform scanning; and an adjustment-chart output unit that outputs an adjustment chart separated into M number of pattern combinations arranged in M number of rows, where M is an integer equal to or greater than 2, each of the M number of pattern combinations containing a plurality of recording patterns having a plurality of dots, used for adjusting deviation of a print position between a respective first dot and a respective second dot among each of the plurality of recording patterns, the plurality of dots of each of the M number of pattern combinations being printed to form images on the recording medium at different positions by using the print head, and each of the plurality of recording patterns are arranged such that respective position deviation amounts of the respective first dot and the respective second dot among each of the plurality of recording patterns differ from one another relative to a reference pattern containing the M number of pattern combinations on a single row, the method comprising:

adjusting an ejection position of the print head based on an adjustment value that is calculated from a deviation amount of a recording pattern selected from the plurality of the recording patterns, wherein respective deviation amounts between the respective first dot and the respective second dot among each of the plurality of recording patterns are M-times the deviation amount between a corresponding first dot and a corresponding second dot in the reference pattern containing the M number of pattern combinations on the single row.

7. The method according to claim 6, wherein the adjusting includes calculating the adjustment value from the respective deviation amounts in each of the plurality of recording patterns, the recording patterns being selected from all of the M number of pattern combinations in a one-to-one relation or in a many-to-one relation, and adjusting the ejection position of the print head based on the calculated adjusted value.

8. The method according to claim 6, wherein the adjusting includes calculating the adjustment value that is an average of deviation amounts in each of the plurality of recording patterns, the recording patterns being selected from all of the M number of pattern combinations in a one-to-one relation or in a many-to-one relation, and adjusting the ejection position of the print head based on the calculated adjusted value.

9. The method according to claim 6, wherein the adjusting includes calculating the adjustment value that is an average of deviation amounts in each of the plurality of recording patterns, the recording patterns being selected from all of the M number of pattern combinations a one-to-one relation, and adjusting the ejection position of the print head based on the calculated adjusted value.

10. The method according to claim 6, further comprising:

accepting a user selection of at least one pattern combination of the M number of pattern combinations in the adjustment chart.

11. A non-transitory computer readable storage medium having computer readable program stored thereon, which when executed, causes a computer to execute a method for adjusting deviation of a print position for a recording apparatus that includes a recording unit that records an image on a recording medium by causing at least one print head, which includes a plurality of nozzles for ejecting ink, to perform scanning; and an adjustment-chart output unit that outputs an adjustment chart separated into M number of pattern combinations arranged in M number of rows, where M is an integer equal to or greater than 2, each of the M number of pattern combinations containing a plurality of recording patterns having a plurality of dots, used for adjusting deviation of a print position between a respective first dot and a respective second dot among each of the plurality of recording patterns, the plurality of dots of each of the M number of pattern combinations being printed to form images on the recording medium at different positions by using the print head, and each of the plurality of recording patterns are arranged such that respective position deviation amounts of the respective first dot and the respective second dot among each of the plurality of recording patterns differ from one another relative to a reference pattern containing the M number of pattern combinations on a single row, the method comprising:

adjusting an ejection position of the print head based on an adjustment value that is calculated from a deviation amount of a recording pattern selected from the plurality of the recording patterns, wherein respective deviation amounts between the respective first dot and the respective second dot among each of the plurality of recording patterns are M-times the deviation amount between a corresponding first dot and a corresponding second dot in the reference pattern containing the M number of pattern combinations on the single row.

* * * * *